United States Patent [19]

Marlow

[11] 4,123,955

[45] Nov. 7, 1978

[54] MITERING DEVICE FOR RECTANGULAR PICTURE FRAMES

[76] Inventor: Glenn Marlow, 3523 Robin Dr., Louisville, Ky. 40216

[21] Appl. No.: 697,413

[22] Filed: Jun. 18, 1976

[51] Int. Cl.[2] ..... B27B 25/08; B27B 27/06

[52] U.S. Cl. ..... 83/435.1; 83/522; 83/581; 83/415; 83/418; 83/425

[58] Field of Search ..... 83/435.1, 761, 762, 83/522, 581, 466.1, 471.3, 486.1, 471.2, 465, 763, 764, 765, 766, 416, 437, 415, 418

[56] References Cited

U.S. PATENT DOCUMENTS

| | | | |
|---|---|---|---|
| 2,881,812 | 4/1959 | Alumbaugh et al. | 83/435.1 |
| 2,905,210 | 9/1959 | Thomas | 83/435.1 |
| 3,782,235 | 1/1974 | Curcio | 83/762 |
| 3,830,127 | 8/1974 | James et al. | 83/435.1 |
| 3,986,420 | 10/1976 | Huntley et al. | 83/435.1 |

*Primary Examiner*—Donald R. Schran

*Attorney, Agent, or Firm*—Arthur F. Robert

[57] ABSTRACT

This mitering device comprises: a unit composed of a slotted panel slidably mountable on a saw table for longitudinally-guided stock-mitering and return movements and a pair of panel-mounted left and right abutments cooperatively presenting front edges which converge forwardly at 45° toward the panel slot and at 90° toward each other and which terminate adjacent the panel slot; and length-measuring stop means including means calibrating the front edge of the right abutment from a zero reference point, where a projection of the front edge intersects the saw plane, and a mitered stop member mounted for adjustment along the right abutment to a selected calibrated position wherein its miter mates with the mitered right end of the stock to set the length of the perimetric surface of the rabbet to a precisely measured value approximating a given mat length plus a desired tolerance.

11 Claims, 11 Drawing Figures

MITERING DEVICE FOR RECTANGULAR PICTURE FRAMES

CROSS REFERENCE TO RELATED APPLICATIONS

A related application has not been filed.

BACKGROUND OF THE INVENTION

1. Field of the Invention

This invention relates to the art of making mitered picture frames or moldings and, more particularly, relates to a mitering device.

2. Description of the Prior Art

Barnes U.S. Pat. No. 556,658 shows a slotted circular panel slidably mountable upon a saw table for longitudinally guide frame cutting and return movements. The panel carries right and left abutment clamps for holding stock on the table while the device is moved to miter the right and left ends of the stock. Barnes doesn't tell the art to position the perimetric surface of a rabbet against the front edge of an abutment.

The Wales U.S. Pat. No. 786,583 shows a pair of holding supports 11, 19 on one of which molding 24 may be mounted to extend at a desired angle across the mitering groove and, on the other of which, molding 25 is mounted at an upper level to extend at a desired angle across the mitering groove. The two moldings 24, 25 are thus positioned at the proper mitering angle, and mitered when pulled through the cutting area.

The Kusterle U.S. Pat. No. 1,548,950 shows a triangle pivoted at one apex end and arranged to carry, at its opposite or base end, a pair of straight converging moldings and a curved molding crossing over each of the straight moldings. The triangular member can be set to one angular position for mitering one straight molding and the adjacent end of the curved molding. Then the triangular molding is turned angularly to position the other straight molding and the other end of the curved molding for a similar mitering operation.

The Fusco U.S. Pat. No. 3,709,266 shows an arrangement wherein two abutments can be fitted to the angle of an existing inside corner, fixed in the fitted position and then removed to a saw table for mitering moldings for the inside corner. The abutments can also be fitted to outside corners for mitering outside moldings.

In the practical art, it is customary to place the face flange of the rabbet of picture frame molding stock against a 45° oblique abutment, miter one end of that stock, then mark another 45° oblique abutment to indicate the desired length of molding, place the stock along that marked abutment with its cut end properly related to the mark and then miter the stock to a molding having a rabbet of desired perimetric length. This operation takes time to perform with precise accuracy and even then is frequently subject to error. So far as I know, the practical art does not miter any end of rabbeted stock with the perimetric surface of its rabbet pressed against the abutment. Nor does it miter the 2nd or last end with the mitered 1st end held by a length measuring stop set in a precisely calibrated position.

SUMMARY OF THE INVENTION

Objects of the Invention

The principal object of the present invention is to provide a device which enables moldings for a rabbeted rectangular picture frame to be mitered rapidly with precise accuracy.

Other important objects are: to reduce the cost of mitering rabbeted rectangular picture moldings; to increase production; to maintain top quality under rapid operating conditions; and to provide a lightweight highly-portable rectangular rabbeted molding mitering device.

Statement of the Invention

In its broadest aspect, my invention comprises: a panel having a saw slot to receive a table saw and being slidably mountable on a saw table for guided back and forth sliding movement; and abutment means including an abutment having a rabbet-receiving front edge for abutting the perimetric surface of the rabbet of said rabbeted stock with the face flange of the rabbet overlying the abutment, said abutment means being firmly mounted to the panel in a position wherein its front edge extends obliquely forward toward and terminates adjacent said panel saw slot.

The preferred form of my invention, in its broadest aspect, additionally includes length-measuring stop means comprising: length calibration means associated with the abutment; and stop means mounted for adjustment along the abutment to a selected calibrated position wherein the stop means is operative to indicate that the stock is set in its proper mitering position for securing a desired perimetric rabbet surface length when the already mitered end of the stock is positioned as indicated by the stop means with the perimetric surface of the rabbet of said stock pressed against the front edge of said abutment. The desired length preferably equals the calibrated length plus a tolerance.

Thus, if a 10 × 10 inch mat is to be placed in the picture frame, the mat-receiving opening, provided by the perimetric rabbet surface of the frame, should be 10 inch W × 10 inch H plus a tolerance normally $\frac{1}{8}$ of an inch. With this tolerance, each perimetric rabbet surface at the sides, top and bottom of the frame must be cut to a length of $10\frac{1}{8}$ inches so that the mat-receiving opening formed thereby will be $10\frac{1}{8} \times 10\frac{1}{8}$ inches. With the stop set to a selected 10 inch calibration, which provides a $10\frac{1}{8}$ inch perimetric surface, the once mitered stock is manually held in its proper mitering position while the unit and the stock are slidably moved rearwardly on the saw table until said stock is mitered. When four frame sections of a $10\frac{1}{8}$ inch selected length are assembled, the $10\frac{1}{8} \times 10\frac{1}{8}$ inch opening will allow a 10 × 10 inch glass cover, single or double mat, the picture and the backing to be easily and quickly set in place within the frame.

My arrangement enables rabbeted rectangular molding to be mitered rapidly, accurately and inexpensively. It enables production to be increased and top quality to be maintained. The device can be made light in weight and highly portable.

For the sake of clarity, the invention is hereinafter described with the 1st abutment on the left and the 2nd (calibrated) abutment on the right but it will be understood that the left and right position of these abutments may be reversed.

BRIEF DESCRIPTION OF THE DRAWINGS

The invention is illustrated in the accompanying drawings wherein.

DESCRIPTION OF THE PREFERRED EMBODIMENT

Figure 1:
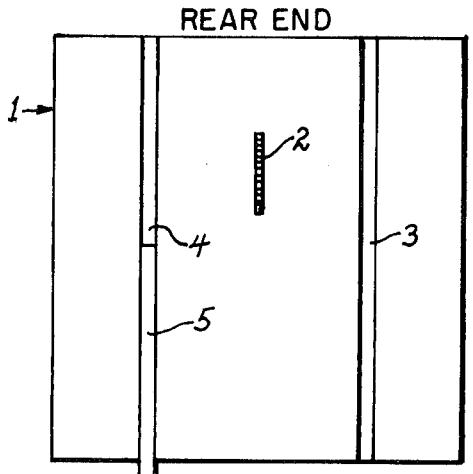
FIG. 1 is a top plan view of a conventional saw table with a mitering device guide projecting horizontally from one of the table grooves.

My device is primarily intended for mitering rabbeted stock to provide moldings for rectangular picture frames. It is primarily used on the top surface of a saw table 1 such as is seen in FIG. 1, which is drawn on a greatly reduced scale. A saw 2 projects upwardly through a saw slot on the table and a pair of left and right longitudinally extending parallel guide grooves 3 and 4 are disposed in the table at equally spaced parallel distances from opposite sides of the saw 2. The left guide groove 4, as shown, contains a slidable guide member 5 for the mitering device projecting horizontally from its front end. This projecting guide member 5 is intended for optional securement in a removable manner to the bottom side of my mitering device.

The specific form of my mitering device, as illustrated, comprises at least four elements, viz: A. a slotted slide panel; B. an integrated cross-frame structure; C. abutment means including a pair of left and right converging abutments; and D. length-measuring stop means including calibrating means along the right abutment and stop means for use on the right abutment.

Slide Panel

Figure 2:
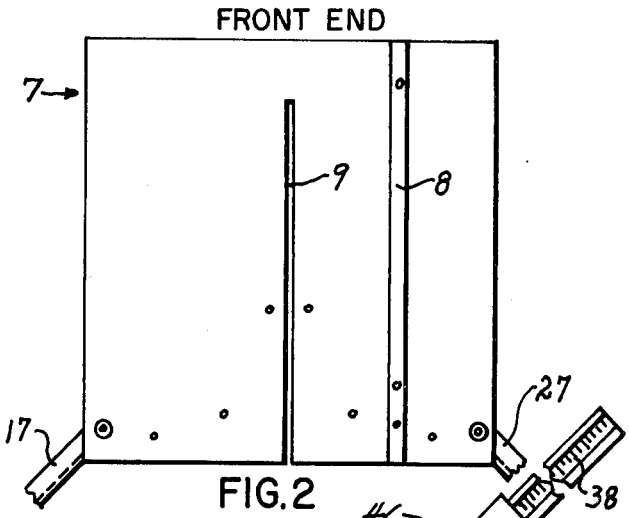
FIG. 2 is a bottom plan view of a mitering device embodying my invention.

FIG. 2, which is drawn on a reduced scale, shows the bottom face of the slide panel 7 with its rear end at the bottom of the figure. The slide panel 7 preferably is composed of strong lightweight plastic having very smooth flat faced top and bottom surfaces to facilitate sliding. The top surface provides a flat unobstructed work face for slidably engaging the flat back face of the stock being mitered. The panel 7 also has at least one elongate guide member 8 firmly secured to it and intended to fit snugly and slidably within groove 3 of the table. It also has an elongate saw-accommodating slot 9 centrally disposed in the panel to extend longitudinally thereof preferably through the rear end edge of the panel but terminating short of its front end edge. While only one guide member 8 need be used, the use of a second guide member is desired by some framers; hence, the elongate guide member 5 may be provided, properly positioned on the bottom face of the panel and adhesively secured thereto preferably by pressure sensitive adhesive means permitting its firm securement and quick removal whenever desired. Both guide members 5 and 8 are preferably composed of a hard plastic having a smooth surface to facilitate their sliding movements in table grooves 3 and 4.

Since the spacing between the saw slot of the saw table 1 and table grooves 3 and 4 may vary from one make of saw table to another, the guide member 8 may be mechanically fastened to the slide panel 7 in a removable manner permitting its spacing from the panel slot 9 to be varied as and when required by the spacing of the table groove 3. The panel may be provided with screw holes or other means marking both positions of guide member 8. Where the panel guide member 5 is to be adhesively secured, its removable securement in a shifted position presents no problem since the regular guide 8 can be placed in table groove 3 with "adhesive" guide 5 placed in table groove 4 whereupon the "adhesive" guide may be firmly secured in proper position simply by pressing the panel 7 downwardly upon "adhesive" guide member 5 to secure it to the panel.

Integrated Cross Frame Structure

Figure 3:
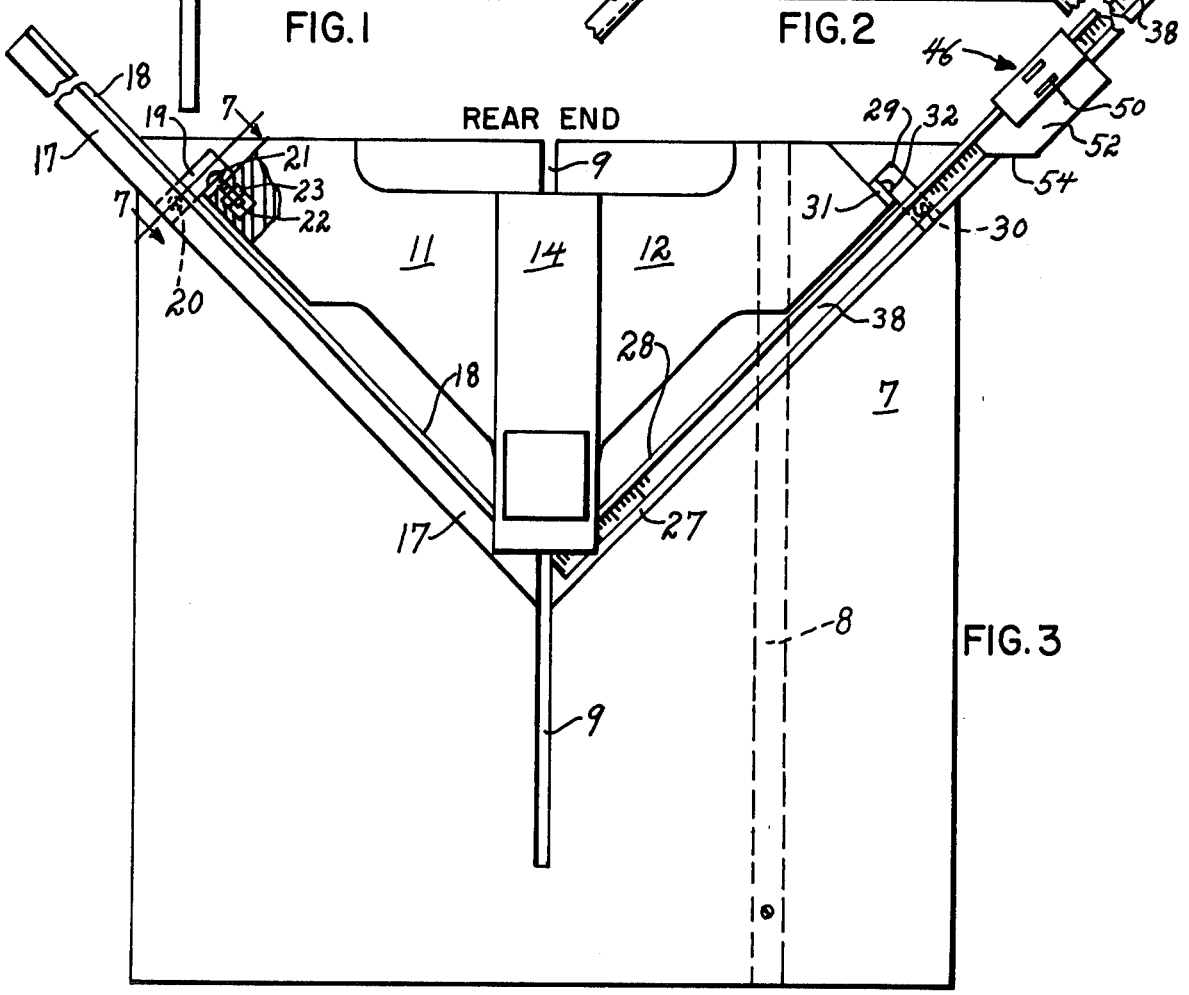
FIG. 3 is a larger scaled partly broken top plan view of the device of FIG. 2.
Figure 4:
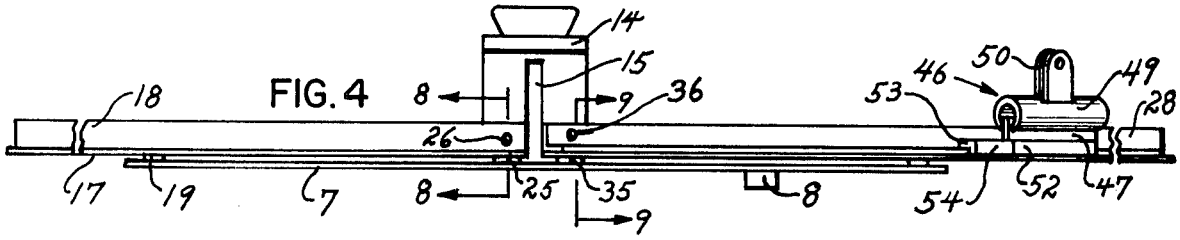
FIG. 4 is an end elevational view looking at the front end of my device, this end being at the top of FIG. 2 and the bottom of FIG. 3.
Figure 5:
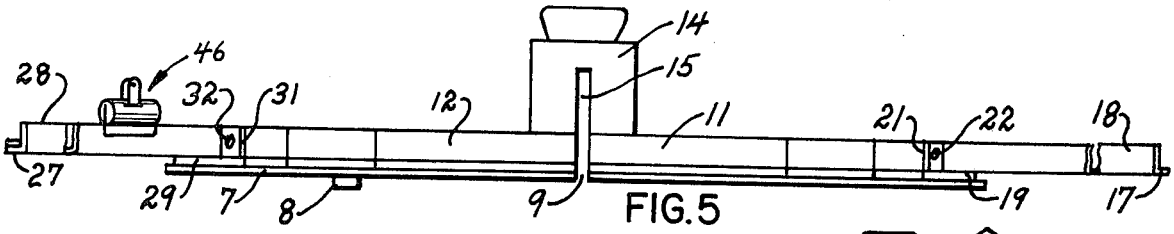
FIG. 5 is a rear end elevational view of the device.
Figure 6:
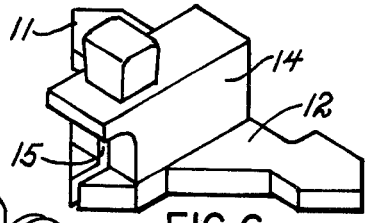
FIG. 6 is a perspective view of an integrated cross frame structure incorporated in my unit.

FIG. 3 shows the top face of the integrated cross frame structure on an enlarged scale relative to FIG. 2 while FIG. 6 shows that structure in perspective. This structure is firmly mounted on the top side of the panel for back and forth movement therewith as a panel-frame unit.

This cross frame structure, as illustrated, comprises: a pair of left and right wing frame members, one on each side of the rear end portion of the panel slot 9, and a saw guard secured to the wing frames in position to bridge the panel slot 9.

In the arrangement illustrated, the left and right wing members 11 and 23 extend along the left and right sides respectively of the slot 9 and form an underlying part of the saw guard 14 bridging that slot. The wing frames 11, 12 and saw guard 14 cooperatively form a triangle across the rear end portion of the panel. The rear end edge of this triangle extends along the rear end edge of the panel from opposite sides of the panel slot to about the left and right rear corners thereof. The central portion of the integrated cross frame extends forwardly a distance such that the longitudinal rear-toward-front length of the saw guard housing is sufficient to accommodate the table saw. The left and right front edges of the left and right wing frames converge toward each other and terminate on opposite sides of the panel slot 9. Each wing frame is preferably made thick but composed of very lightweight material, such as fiberboard, chipboard, etc. Each wing frame is firmly secured to the top face of the panel in any suitable way. I prefer to glue-bond the wing frames to the panel and then supplement the glue-bond by screws, one screw adjacent each of the three corners of each frame.

The saw guard 14 may be composed of any suitable material. I prefer the use of very hard dense wood such as a block of maple or other hardwood, extending longitudinally over the rear longitudinal end portion of the panel slot 9. The block is provided with a saw-accommodating centrally-disposed slot 15. The bottom of the saw guard housing may be glue-bonded or otherwise secured directly to the panel adjacent panel slot 9. I prefer, however, to extend the wing frames underneath the saw guard housing and bond the saw guard housing to the top surface of the wing frames so that they both cooperate to form the center slot 15 of said integrated cross frame.

As noted before, the panel-frame unit, resulting when the wing frames 11 and 12 are secured to the panel 7, is characterized by forwardly converging front peripheral edges. Each wing frame is recessed between its front center and rear corner portions; hence, the converging front edges are discontinuous.

Rabbet-Receiving Abutment Means

FIG. 3 illustrates a top plan view of the abutment means which includes a pair of rabbet-receiving left and right or 1st and 2nd abutments mounted on the left and right sides of the slide panel 7 to converge at a 45° angle from the rear corners of the panel forwardly to the panel slot 9 where they terminate on opposite sides thereof. Stated reversely, these rabbet-receiving abutments diverge rearwardly from panel slot 9 toward and project beyond the rear corners of the panel. The abutments may be composed of any suitable material, such as stainless steel, aluminum, etc. and fashioned in any suitable shape. As illustrated, they are in the form of elongate 90° angle "irons", having horizontal bottom and vertical back sides or walls.

Rabbet-Receiving Left Abutment

The 1st or left abutment 17, 18 has a horizontal bottom side or wall 17 presenting a front abutment edge and a vertical back side or wall 18. This abutment is not only mechanically secured in place but also slightly elevated above the top surface of the panel by one mechanical fastening at the rear corner of the left cross frame and another mechanical fastening adjacent the front apex of the triangular cross frame.

Figure 7:
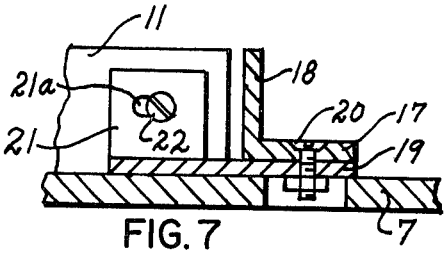
FIG. 7 is a section taken along line 7—7 of FIG. 3.

As seen in FIGS. 3 and 7, the left rear corner securement of the left abutment, comprises: an underlying bracket 19, which elevates the left abutment and which is secured to the horizontal bottom wall 17 of the left abutment by means of a countersunk screw 20, which is not secured to the panel. The bracket 19 extends rearwardly and has an upstanding flange 21 along its right rear edge. Flange 21 is secured to the adjacent portion of the left wing cross frame 11.

To stabilize the securement of the flange 21 to the structurally weak lightweight cross frame 11, a securing screw 22 passes successively through the upstanding flange 21 and the adjacent portion of the left wing frame and, as seen in FIG. 3, projects into a bottom open slot of the cross frame where it is threaded to a non-turnable nut 23. The screw 22 and non-turnable nut 23 cooperate to clamp the bracket flange 21 and the intervening portion of the wing frame between them and thus provide a firm anchorage for bracket 19. The bracket flange 21 is horizontally slotted at **21*a* and the corresponding hole in panel 7 is enlarged to clear the securing nut for screw 20 so that bracket 19 and the adjacent portion of the 1st or left abutment may be moved to the right, from the normal FIG. 7 position, to increase the normal 45° miter angle between the rear end portion of the saw plane and the abutment very slightly above 45° for well known frame tensioning purposes. The rightward movement of flange 19 and the adjacent portion of the left abutment 17, 18 of FIG. 7 is relative to both the panel 7 and the left cross frame 11**.

Figure 8:
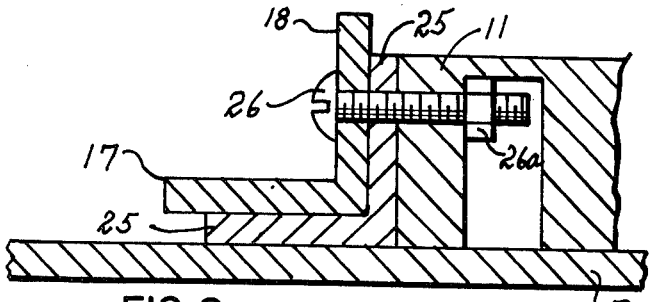
FIG. 8 is a section taken along line 8—8 of FIG. 4.

As seen in FIG. 8, the left abutment 17, 18, adjacent the front apex of the cross frame member 11, is elevated by the foot of an L-shaped flange or fitting 25 and firmly secured in place by a screw 26 extending horizontally successively through the vertical back wall 18 of the left abutment and the vertical leg of the L-shaped flange 25, from which screw 26 projects rearwardly into the left wing frame member 11 near the apex thereof. This connection may be stabilized through the use of a panel slot containing a non-turnable nut **26*a* corresponding to the non-turnable nut 23**.

The forwardly converging elevated front edge of the horizontal bottom wall 17 of the left abutment functions to abut the perimetric surface of the rabbet in rabbeted molding stock resting on the panel 7 and to hold that stock against rearward displacement from its proper mitering position. When the right end, of the molding stock to be mitered, is positioned to cross the vertical mitering plane of the saw at the place where the stock crosses the slot 9 of panel 7, the stock is in its proper mitering position on the left abutment under these conditions, viz: the bottom surface of the stock is pressed against the top of the panel; the perimetric surface of its rabbet is pressed rearwardly against the elevated converging front edge of the abutment bottom wall 17; the front surface of its rabbet extends over said abutment wall 17; and the right end of the stock passes through the mitering plane. Consequently, when the mitering device and the rabbeted stock are pushed rearwardly, with the stock held in its proper mitering position, its right end will pass across the saw and thus be mitered accurately at a 45° angle.

Rabbet-Receiving Right Abutment

The construction, arrangement and securement of the right abutment 27, 28 is identical to that of the left abutment 17, 18 except: that the right abutment, as illustrated, is longer than the left; that it diverges rearwardly to the right instead of to the left; and that it does not require the use of an adjusting slot corresponding to slot **21*a* in upstanding flange 19. Otherwise, the right abutment 27, 28 has parts corresponding to or associated with parts 17–23 and 25, 26 and 26*a* of the left abutment. While not all of these parts need be shown, they comprise: a horizontally-elongate forwardly converging right angle abutment 27, 28 having a horizontal bottom wall 27, presenting a front edge, and a vertical back wall 28; an underlying bracket 29; a countersunk screw 30; an upstanding flange 31 on bracket 29; a securing screw 32; non-turnable nut 33 (not shown); and an L-shaped flange 35 with securing screw 36 and nut 36*a***.

The forwardly converging elevated front edge of the bottom wall 27 of the right abutment functions to engage the perimetric surface 56 of the rabbet in said rabbeted stock and to hold that stock against rearward displacement from its mitering position, wherein its left end, which is to be mitered, crosses the vertical mitering plane at the place where it also crosses slot 9 of panel 7. Consequently, when the mitering device is pushed rearwardly, with the stock held in its proper mitering position thereon, the left end of the stock will pass across the mitering saw and thus be mitered accurately at a 45° angle.

However, my invention additionally makes it possible to insure that, in mitering the left end of the stock, the end-to-end length of the perimetric surface of the rabbet will have the exact length dimension desired. This result is insured by the length-measuring stop means incorporated in my device.

Length-Measuring Stop Means

The length-measuring stop means comprises: calibrated means associated with the right abutment; and stop means mounted for adjustment along said calibrated abutment to a selected calibration indicating a measured or known length of perimetric rabbet surface. This length approximates the length dimension of one side of a mat.

The calibrated means comprises a calibrated scale or rule 38 which may be formed in or otherwise associated with the right abutment in any suitable way. Preferably, a physically-separate calibrated scale 38 is firmly secured to the top surface of the bottom wall 27 of the right abutment to extend therealong with its zero calibration providing a zero vertical reference plane 39 which extends at a 45° angle to the vertical plane 40 of the right face of the saw and at a 90° angle to the vertical plane 41 of the front edge 42 of abutment 27 and which intersects both planes 40 and 41 at common point 43. This common point, incidentally, is the left end point of the perimetric rabbet surface of the stock which is pressed against front edge 42 and cut along the saw plane 40.

The stop means which is mounted for adjustment along said right abutment to a selected calibrated position, comprises: a spring clip; and a stop block.

Figure 10:
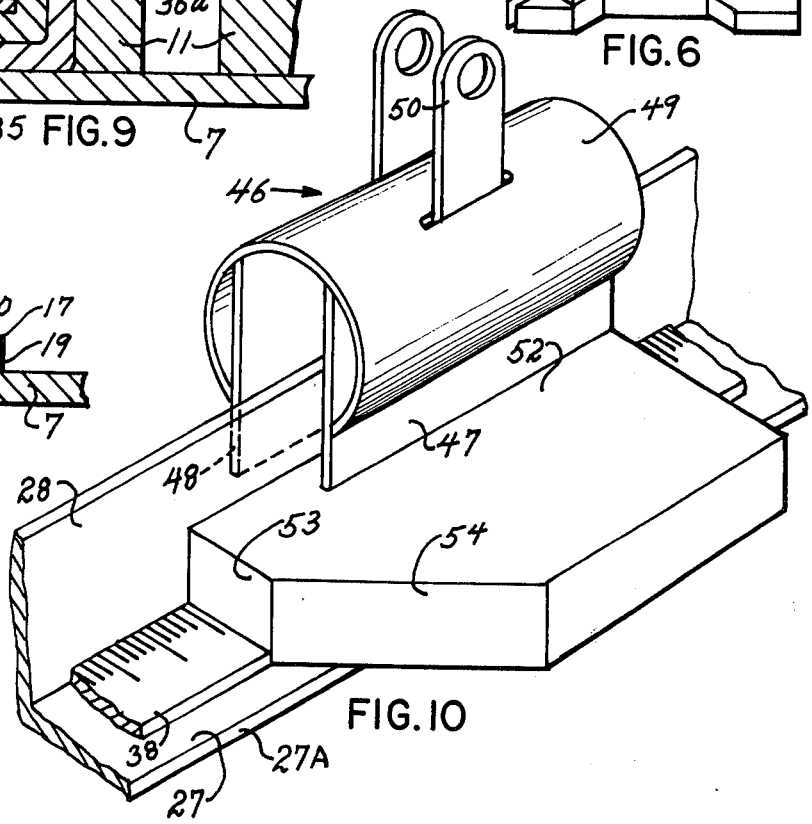
FIG. 10 is an enlarged fragmentary perspective view of the stop mounted on the rear vertical wall of the abutment as shown at the upper righthand corner of FIG. 3.

As seen in FIG. 10, the spring clip 46 is of a conventional type comprising: a pair of downwardly extending front and rear clamping members 47, 48; a slotted cylindrical spring 49 biasing the clamp closed; and a pair of upwardly-extending fingers 50 for manually opening the clamp.

The stop block illustrated comprises: a block of wood 52, the top side of which is firmly secured to the lower edge of the front clamping member 47. The perimeter of the wood block 52 includes: a flat back wall for clamping engagement with the upright wall 28 of the right abutment; a left square cut end face portion 53, which preferably extends at a right angle to the flat back wall of the wood block 52; and a mitered left front corner portion 54 which slopes forwardly to the right from the square cut end face portion 53 at an angle of 45°.

Figure 11:
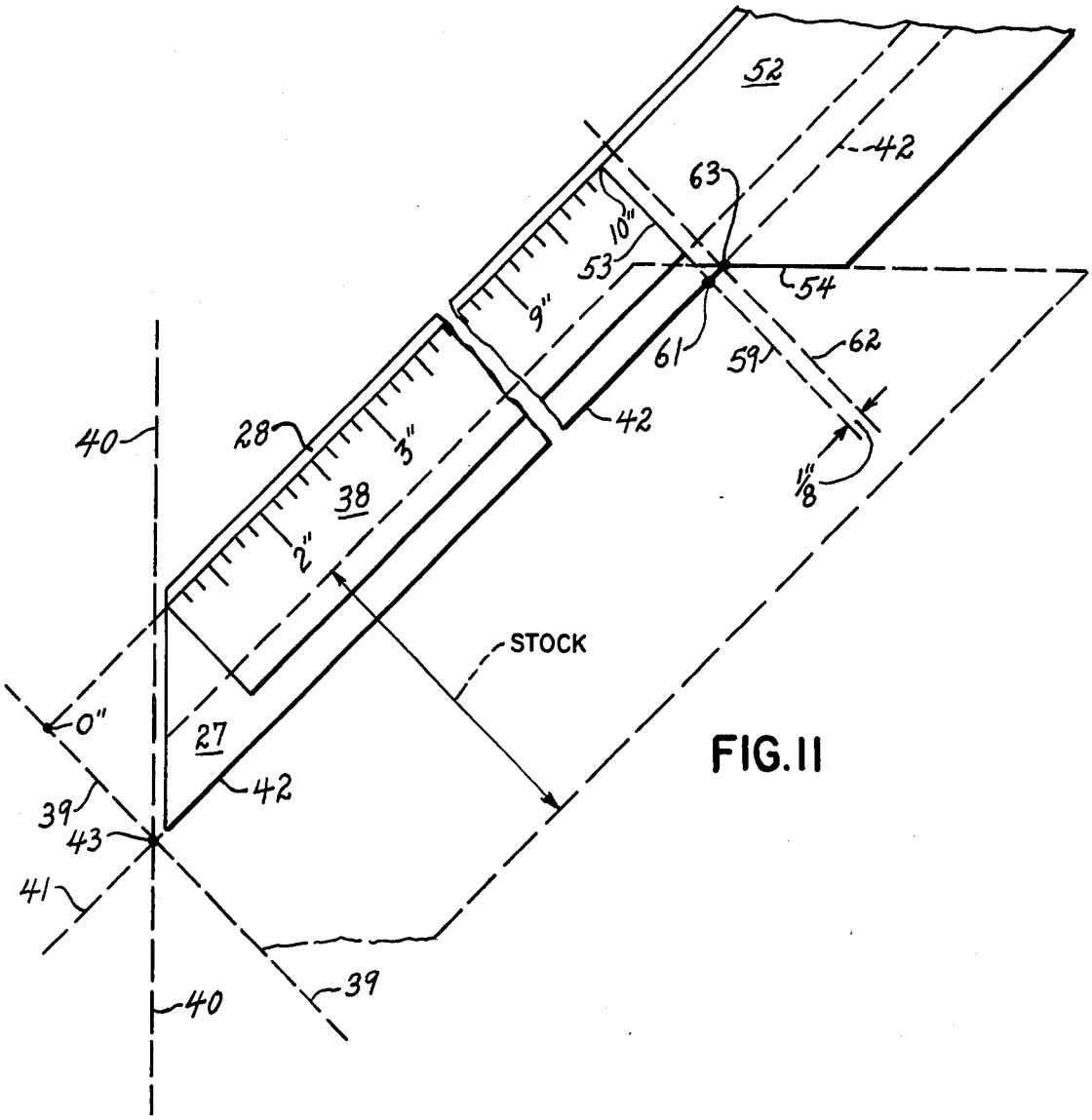
FIG. 11 is a somewhat schematic view showing the relationship between the stock and the saw plane, the right abutment and the length-measuring stop means.

In summary, it may be noted: that the scale means designates length dimensions along the front edge 42 of the abutment; that the vertical plane of the square cut end face 53 of stop 52 intersects the scale means and the front edge 42 at corresponding points and thus "calibrates" the front edge 42; that, as illustrated in the drawings and particularly in FIG. 11, the plane 59 of the square cut end face 53 of the stop intersects the front edge 42 at the calibrated 10 inch point 61, which for a 10 × 10 inch frame, corresponds to and equals or closely approximates the length dimension of each side of a 10 × 10 inch mat for a 10 × 10 inch frame; that the vertical plane 62 intersects the sloping face 54 of the stop means 52 and the end of front edge 42 at point 6 which corresponds to and equals the length dimension each side of a 10 × 10 inch mat plus a tolerance; and that these two dimensions aggregate 10⅛th inches, which is the precise end-to-end length dimension of the perimetric rabbet surface for each side of said 10 × 10 inch frame.

Operation

In operation, we will assume: that the mitering device is located on a saw table; and that each of the four moldings, of a rectangular frame having what the framers call a 10 × 10 inch rectangular opening formed by the perimetric surfaces of its rabbet, has a 10⅛th inch perimetric surface. In other words, to the framers, the frame to be formed will be a 10 × 10 inch frame but, since that frame has a built-in tolerance of ⅛th of an inch, the opening formed by its perimetric surfaces will actually be 10⅛ × 10⅛ inches. We also assume that the framer starts with unmitered molding stock, say 60 inches long.

With these assumptions, the stock is 1st placed on the left side of the flat unobstructed work face of the panel and moved rearwardly to press its perimetric surface 56 against the front edge of abutment 17 with the face flange 57 of the rabbet overlying the abutment (see FIG. 9) and with the right end of the stock projecting through the cutting plane of the saw sufficiently for mitering purposes. Now the stock and the panel-abutment unit are moved rearwardly to the extent required to miter the right end of the stock.

Now, as seen in FIG. 10, the length-measuring stop means on the right abutment is spring-clipped or clamped over the top edge of the upright wall 28 of the right abutment with the bottom of wood block 52 preferably resting flatly upon calibrated rule 38 and with its square cut end portion 53 extending at a right angle to said upright back wall 28.

Next, as seen in FIG. 11, the stop means is adjusted along the right abutment to the selected calibration, which, in this assumed case, is the 10 inch calibration for a 10 × 10 inch mat assembly. Here its transverse square cut end portion 53 abuts the vertical plane 59 of the selected 10 inch calibration at a right angle to the front edge 42 of the right abutment 27 and thus calibrates edge 42 with said 10 inch mat calibration. At this point, it may be noted that, when the stop is set at the 10 inch calibration, two lengths are provided, namely: a set mat length of 10 inches between the zero reference plane 39 and the set plane 59 of the 10 inch calibration; and a tolerance length of ⅛th of an inch between the set plane 59 and the tolerance plane 62. The total length of 10⅛ inches, from point 43 in zero reference plane 39 to point 63 in tolerance plane 62, precisely represents the total length of the perimetric surface of the molding to be produced.

When the stop means is in place, the stock is placed with its back face on the flat top face of the slide panel, with its perimetric surface pressed against the front edge 42 of the right abutment 27 and with its mitered right end mated with the mitered end face 54 of the stop. Now the stock and the panel-abutment unit are moved rearwardly sufficiently to miter the left end of the stock along the cutting plane 40. This completes the production of one molding having a perimetric surface 10⅛ inches in length.

It will be appreciated that my mitering device is simply constructed and easily operated. It enables rabbeted rectangular moldings to be mitered rapidly, accurately and inexpensively with a consequent increase in top quality production. These desirable results stem largely from two features of my design. One feature resides in the provision of an abutment having a front rabbet-receiving edge against which the perimetric surface 56 of the stock's rabbet may be pressed with the face flange of the rabbet overlying the abutment. Another features resides in the provision of the length-measuring stop means which enables the perimetric rabbet surface 56 of the stock to be cut to a measured or desired length with a built-in tolerance.

In this connection, it may also be noted that, if an exact perimetric surface length setting were desired, it could readily be obtained by using a stop with its set plane 59 coinciding with its tolerance plane 62. In this case the $\frac{1}{8}$ inch tolerance for a 10 × 10 inch frame, the 10 inch mat length and the $10\frac{1}{8}$ inch perimetric surface length would all remain the same, only the setting would be changed. Also, a different built-in tolerance could be obtained with appropriately different spacing between the set and tolerance planes 59 and 62. Furthermore, a desired tolerance, say $\frac{1}{8}$ inch, can be built in the device at the left end of the abutment by appropriately shifting the rule 38 enough to the right to effect a $\frac{1}{8}$ inch shift to the right of the zero reference plane 39 and by using a stop with its set plane 59 coinciding with its tolerance plane 62 which, as stated before, eliminates the tolerance at the right end. In this case, the framer would set the stop at the 10 inch calibration to obtain the $10\frac{1}{8}$ inch dimension. For clarity, the term "selected scale calibration approximating a desired mat length dimension", as used herein, designates, in a 10 × 10 inch frame, for example, a calibration which insures mitering to the desired $10\frac{1}{8}$ inch perimetric length. Such a calibration may range from a mat length of about 10 inches to an end-to-end perimetric surface length of about $10\frac{1}{8}$ inches, as hereinbefore indicated.

Some framers like to miter the stock so that when it is assembled, the mitered faces of the last joint remain apart until they are forced together. This places the entire frame under tension when the last joint is closed and is forced to remain closed. With my device, this may be readily accomplished by loosening screw 22 sufficiently to permit the bracket 21, flange 19 and the adjacent portion of the abutment 17, 18 to be forced to the right to the slight extent desired. This movement is permitted by slot 21*a* in flange 19 and by the panel 7 hole, which accommodates the lower end of the screw 20 and the nut on it. When these parts are thus moved, the right end of the abutment 17 is forced toward cutting plane of the saw in a manner which increases the 45° angle normally between the saw housing 14 and the left abutment. When the moved parts are secured by tightening screw 22, the miter on the right end of the stock will thereafter be altered to a slight but sufficient extent to accomplish the frame-tensioning objective mentioned.

It may be desirable in some instances to provide one slide panel for the left abutment 17, and another slide panel for the right abutment 27. This would enable one operator to miter only the right end of the stock on the left abutment and then pass it on to another operator who miters only the left end of the same stock.

For the sake of clarity, we note: that, in the plus tolerance arrangement illustrated in FIG. 11, the zero reference plane 39 and the tolerance plane 62 constitute the opposite end planes of the perimetric surface; and that, in the suggested zero tolerance arrangement, the zero reference plane 39 and the 10 inch set plane 59 constitute the opposite end planes of the perimetric surface. In the suggested minus tolerance arrangement, the $\frac{1}{8}$th inch tolerance is provided, between the right face saw plane and the zero reference plane, by shifting scale 38 $\frac{1}{8}$th of an inch to the right of its position in FIG. 11. Also the term "measured length" refers to the calibrated or set length between the zero point on scale 38 and the selected calibration point on that scale.

Figure 9:
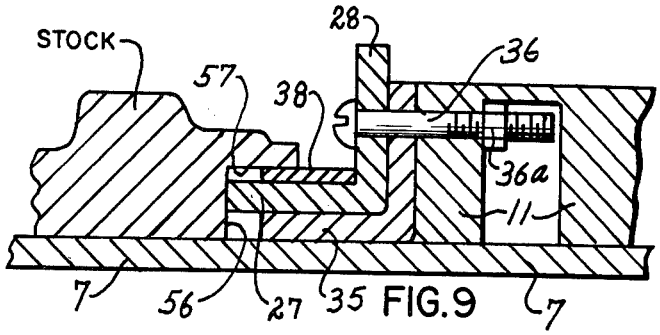
FIG. 9 is a section taken along line 9—9 of FIG. 4, this view additionally showing the relationship of a positioned molding to the abutment and calibrating scale.

It will be understood that, as used herein, the expression "rabbeted stock" means stock having a rabbet comprising: a perimetric surface and face flange respectively corresponding to the perimetric surface 56 and face flange 57 of FIG. 9.

Having described my invention, I claim:

1. A device for mitering rabbeted stock in making picture frame members on a table associated with an operatively mounted mitering saw, comprising:

A. a portable panel having a flat work face for engaging the flat back face of the stock being mitered, a front end, a rear end and a forwardly-rearwardly extending slot between such ends to receive said mitering saw,
   1. said panel being removably mountable on the table for guided back and forth sliding movement;

B. a panel-mounted abutment means including an abutment
   1. having an elongate rabbet-receiving abutment edge facing outwardly away from the vertical plane of the saw in a position where said outer abutment edge
      a. is adjacent to the work face of the panel,
      b. is operative to abut the perimetric surface of rabbeted stock having its flat back face resting on the panel,
      c. underlies the face flange of the rabbeted stock it abuts,
      d. converges obliquely toward and terminates adjacent the panel saw slot, and
      e. faces outwardly over substantially unobstructed space adjacent the panel to permit said resting stock to be slidably moved on the panel into and out of perimetric surface abutment with said rabbet-receiving abutment edge;

C. scale means associated with said abutment
   1. for calibrating said rabbeting-receiving outer abutment edge in terms of length dimensions beginning with a reference point in the vicinity of the saw plane; and D. stop means associated with said abutment and settable to a selected calibration
   1. where said calibrated outer abutment edge provides, between said stop means and the plane of the adjacent face of the mitering saw, the precise end-to-end length dimension desired of the perimetric surface of the rabbet, and
   2. where said stop means is operative, when rabbeted stock is operatively positioned with its back face resting on the work face of the panel, with its perimetric surface abutting said calibrated outer abutment edge and with the once mitered end of the stock abutting said stop means, to hold the stock against endwise movement outwardly beyond said operative position while the stock is mitered at said saw plane.

2. The device of claim 1 wherein:

A. said abutment is in the form of a horizontally long unitary angle member of L-section having
   a. a vertical short wall on its inner side, and
   b. a horizontally narrow bottom wall terminating, on its outer side, in said outer abutment edge.

3. The device of claim 1 wherein:

A. a rigidly integrated frame structure extends from the rear side of said abutment means across said saw slot and is rigidly secured to both the abutment means and the panel, 1. said frame structure including a saw guard at the slot.

4. The device of claim 1 wherein:

A. said selected calibration designates the length dimension of one side of a given mat.

5. The device of claim 4 wherein:

A. said abutment is the 2nd abutment of a pair of 1st and 2nd abutments which are mounted on opposite 1st and 2nd sides of the panel slot with their outer edges converging toward the slot at a 45° angle and toward each other at a 90° angle, 1. the 1st abutment being operatively mounted on said 1st side for use during a 1st end mitering operation for one frame member, and
2. the 2nd abutment being operatively mounted on said 2nd side for use during the 2nd end mitering operation for the same frame member.

6. The device of claim 5 wherein:

A. each abutment is in the form of a horizontally long unitary angle member of L-section having a. a vertical short wall on its inner side, and
b. a horizontally narrow bottom wall terminating, on its outer side, in said outer abutment edge.

7. The device of claim 6 wherein:

A. said stop means has means for indicating the selected calibration to which it is set.

8. The device of claim 6 wherein:

A. said stop means has spring actuated means for releasably clamping it to the abutment means at a desired setting.

9. The device of claim 6 wherein:

A. said stop means has 1. a square cut end face portion extending outwardly across the horizontal wall of the 2nd abutment, and
2. an adjacent end face portion obliquely sloped at a 45° angle to mate with said already mitered one end of said rabbeted stock when the stock is brought into its operative position for the 2nd mitering operation.

10. The device of claim 1 wherein:

A. said abutment is the 2nd abutment of a pair of 1st and 2nd corresponding abutments which are operatively mounted on opposite 1st and 2nd sides of the panel slot with their outer edges converging toward the slot and toward each other at a 90° angle 1. the 1st abutment being mounted on said 1st side for use during a 1st end mitering operation for one frame member, and
2. the 2nd abutment being mounted on said 2nd side for use during the 2nd end mitering operation for the same frame member.

11. The device of claim 10 including:

A. the rabbet-receiving outer edges of said 1st and 2nd abutments are forwardly converging front edges; and B. an integrated frame structure arranged on the rear side of said converging front edges and firmly mounted on the top side of said slide panel for back and forth movement therewith as a panel-frame unit and fashioned to present a longitudinally extending open-ended saw slot vertically aligned not only with the vertical plane of said panel slot but also with said table saw slot when the panel-frame unit is operatively placed on the table, 1. said integrated frame structure comprising a. a centrally disposed saw guard, which progressively houses the table saw as the panel-frame unit slides forward over the table during a mitering operation,
b. a pair of right and left fixed wing frames extending laterally outward on opposite sides of the saw guard and presenting forwardly converging front end edge surfaces; and C. said pair of right and left abutments being secured to the panel-frame unit in position to extend along said converging front end edge surfaces of said right and left wing frames.

* * * * *